US008769769B1

(12) United States Patent
Owen

(10) Patent No.: US 8,769,769 B1
(45) Date of Patent: Jul. 8, 2014

(54) FLOOR CLEANING APPARATUS

(76) Inventor: Alan Owen, Longmount, CO (US)

( * ) Notice: Subject to any disclaimer, the term of this patent is extended or adjusted under 35 U.S.C. 154(b) by 607 days.

(21) Appl. No.: 13/082,588

(22) Filed: Apr. 8, 2011

(51) Int. Cl.

| | |
|---|---|
| ***A47L 9/10*** | (2006.01) |
| ***A47L 9/20*** | (2006.01) |
| ***A47L 5/00*** | (2006.01) |
| ***A47L 9/00*** | (2006.01) |
| ***A47L 5/10*** | (2006.01) |
| ***A47L 5/26*** | (2006.01) |

(52) U.S. Cl.
USPC ..... 15/349; 15/388; 15/330

(58) Field of Classification Search
USPC ..... 15/388, 349, 374, 330, 331
See application file for complete search history.

(56) References Cited

U.S. PATENT DOCUMENTS

| | | | | |
|---|---|---|---|---|
| 965,764 | A * | 7/1910 | Stephens et al. | 15/84 |
| 1,396,263 | A * | 11/1921 | Diephouse | 15/343 |
| 3,691,581 | A | 9/1972 | Coult | |
| 3,755,845 | A | 9/1973 | Coult | |
| 4,360,939 | A | 11/1982 | Krumm et al. | |
| 4,658,458 | A | 4/1987 | Berfield et al. | |
| D297,779 | S | 9/1988 | Linde | |
| 6,321,405 | B1 | 11/2001 | Whittaker et al. | |
| 6,449,800 | B1 | 9/2002 | Gotham | |
| 7,213,297 | B2 * | 5/2007 | Nam et al. | 15/334 |

* cited by examiner

*Primary Examiner* — Bryan R Muller

(57) ABSTRACT

A floor cleaning apparatus includes a housing that has a top wall and a perimeter wall attached to and extending downwardly from the top wall. The perimeter wall includes a front wall, a rear wall, a first lateral wall and a second lateral wall. A plurality of wheels is rotatably coupled to the housing. Each of the first and second lateral walls has two of the wheels positioned thereon. A brush is mounted to the housing beneath the top wall. A debris catch is mounted in the first lateral wall and catches debris moved by the brush. The brush directs debris toward the debris catch. A handle is attached to and extending upwardly from the housing.

5 Claims, 4 Drawing Sheets

FLOOR CLEANING APPARATUS

BACKGROUND OF THE DISCLOSURE

Field of the Disclosure

The disclosure relates to floor cleaning devices and more particularly pertains to a new floor cleaning device for automatically sweeping a floor or ground surface.

SUMMARY OF THE DISCLOSURE

An embodiment of the disclosure meets the needs presented above by generally comprising a housing that has a top wall and a perimeter wall attached to and extending downwardly from the top wall. The perimeter wall includes a front wall, a rear wall, a first lateral wall and a second lateral wall. A plurality of wheels is rotatably coupled to the housing. Each of the first and second lateral walls has two of the wheels positioned thereon. A brush is mounted to the housing beneath the top wall. A debris catch is mounted in the first lateral wall and catches debris moved by the brush. The brush is configured to direct debris toward the debris catch. A handle is attached to and extending upwardly from the housing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
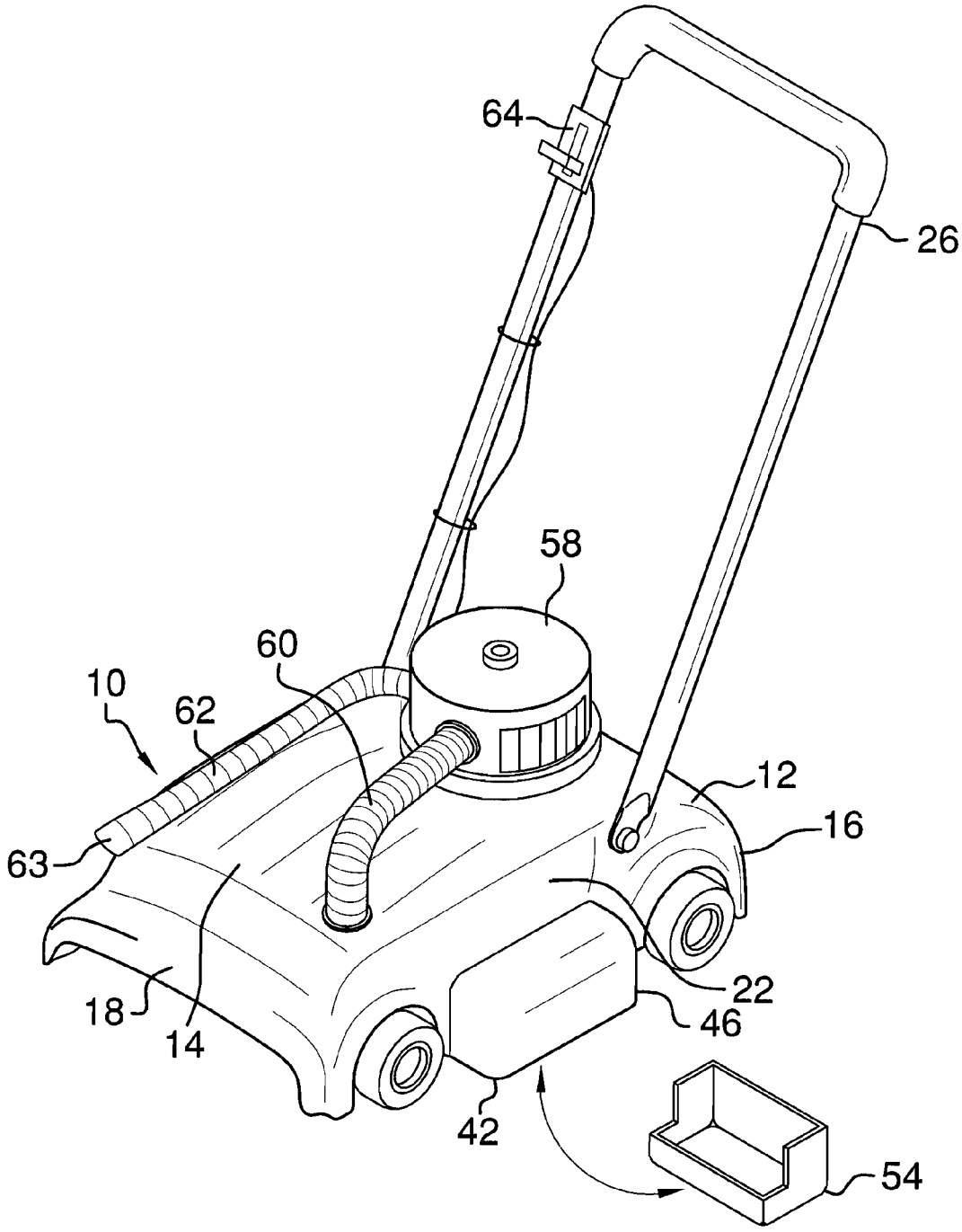
FIG. 1 is a top perspective view of a floor cleaning apparatus according to an embodiment of the disclosure.
Figure 2:
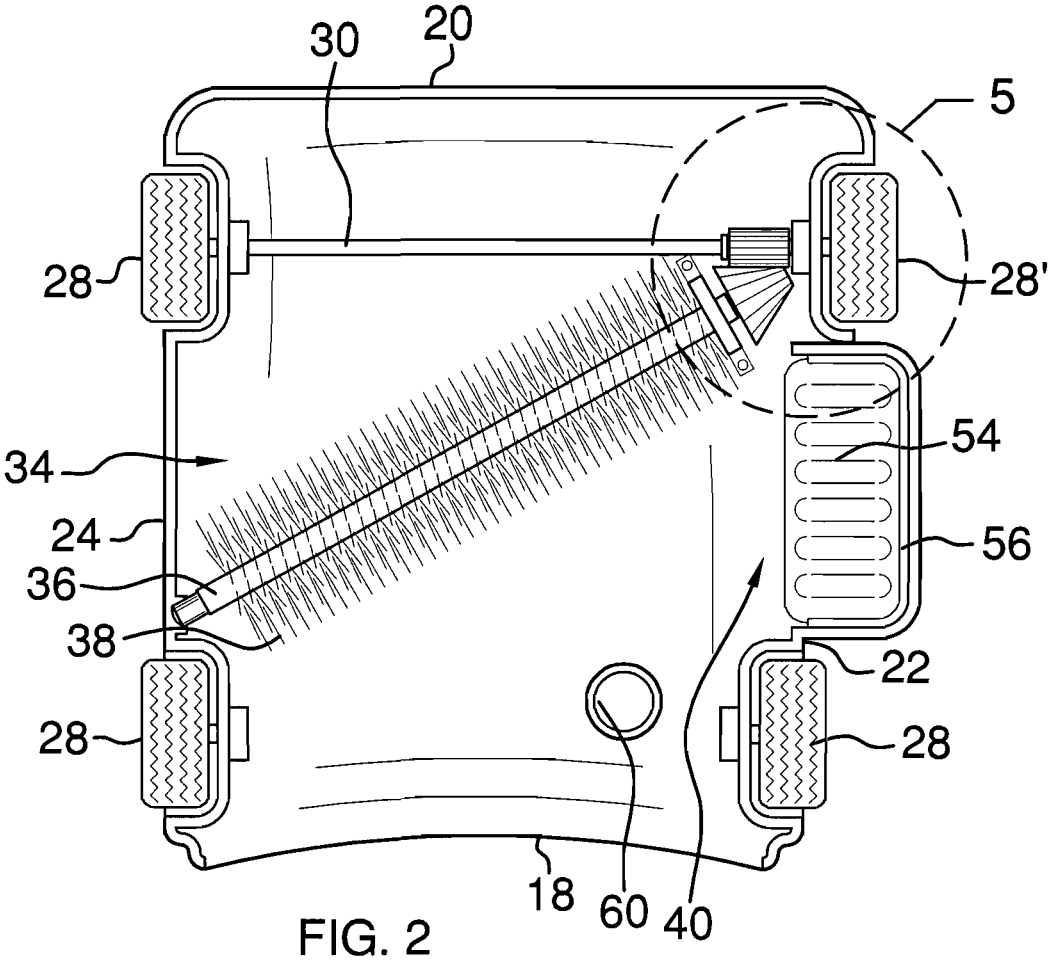
FIG. 2 is a bottom view of an embodiment of the disclosure.
Figure 3:
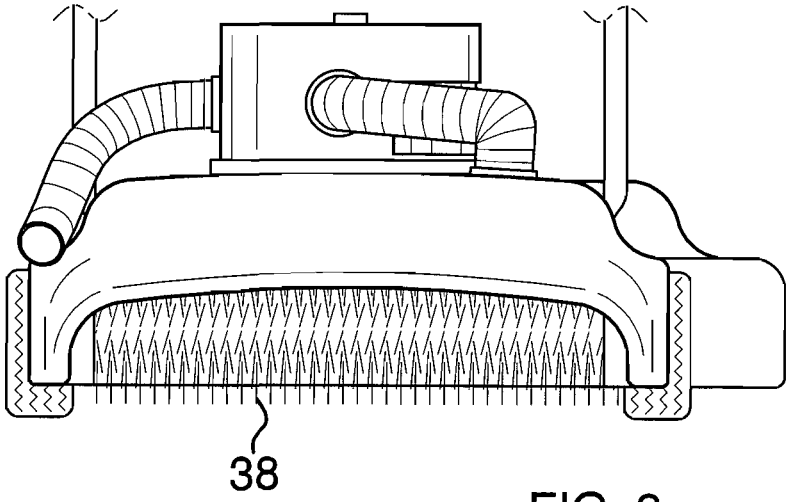
FIG. 3 is a front view of an embodiment of the disclosure.
Figure 4:
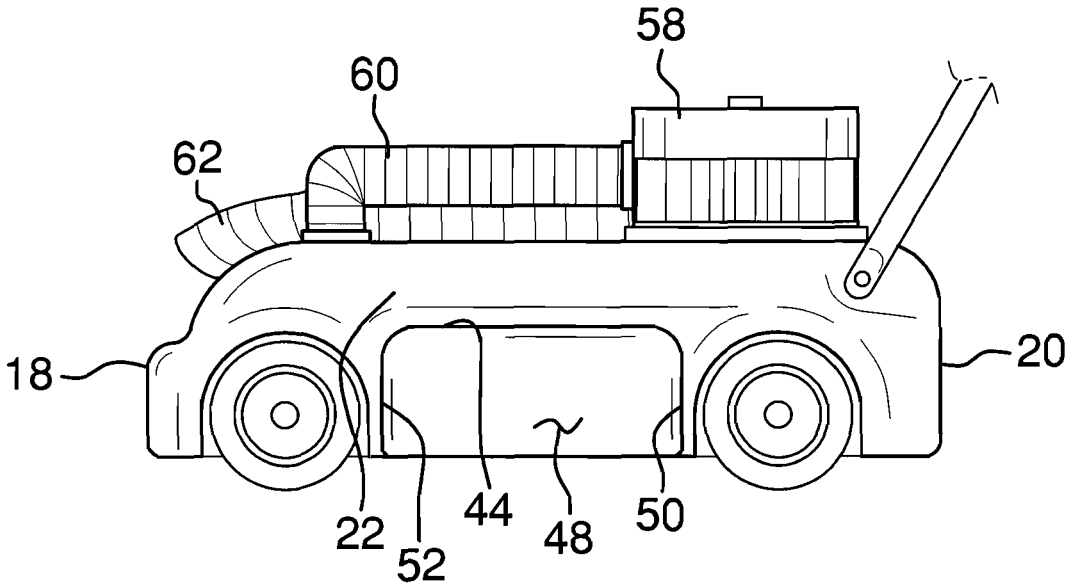
FIG. 4 is a side view of an embodiment of the disclosure.
Figure 6:
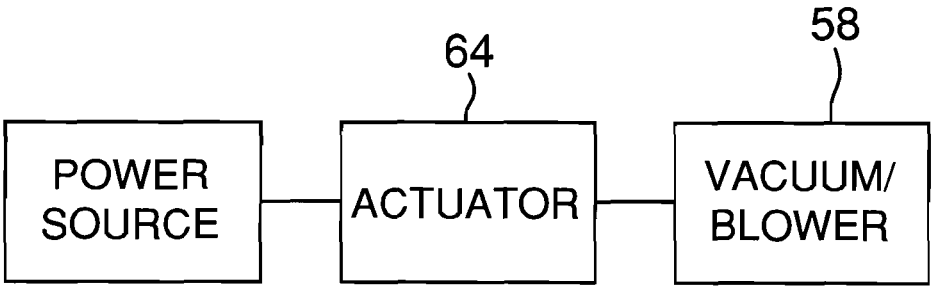
FIG. 6 is a schematic view of an embodiment of the disclosure.
Figure 5:
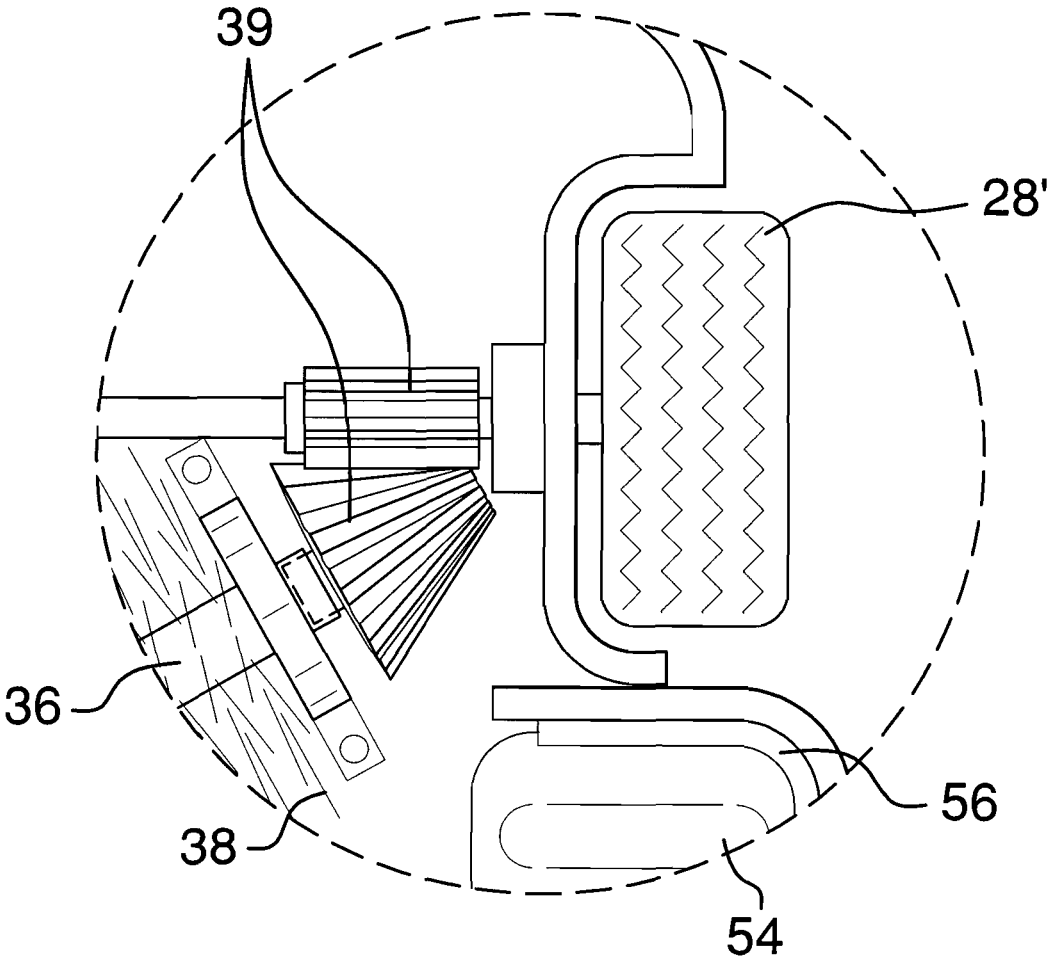
FIG. 5 is an enlarged view of area "5" of FIG. 2 of an embodiment of the disclosure.

With reference now to the drawings, and in particular to FIGS. 1 through 6 thereof, a new floor cleaning device embodying the principles and concepts of an embodiment of the disclosure and generally designated by the reference numeral 10 will be described.

As best illustrated in FIGS. 1 through 6, the floor cleaning apparatus 10 generally comprises a housing 12 that has a top wall 14 and a perimeter wall 16 that is attached to and extends downwardly from the top wall 14. The perimeter wall 16 includes a front wall 18, a rear wall 20, a first lateral wall 22 and a second lateral wall 24. The rear wall 20 and the first 22 and second 24 lateral walls may extend downwardly from the top wall 14 more than the front wall 18 to allow debris to easily move under the housing 12 as the housing 12 is moved across a floor or ground surface. A handle 26 is attached to and extends upwardly from the housing 12.

A plurality of wheels 28 is rotatably coupled to the housing 12. Each of the first 22 and second 24 lateral walls has two of the wheels 28 positioned thereon. At least two of the wheels 28 may be attached to an axle 30 that extend from the first lateral wall 22 to the second lateral wall 24.

A brush 34 is mounted to the housing 12 beneath the top wall 14. The brush 34 includes an elongated spindle 36 extending between the first 22 and second 24 lateral walls. A plurality of bristles 38 is mounted to the spindle 36. The spindle 36 is mechanically coupled to a first wheel 28' of the plurality of wheels 28 by gears 39 so that the spindle 36 rotates when the first wheel 28' rotates. The brush 34 rotates in a first direction configured to move debris toward the front wall 18. The brush 34 is angled from the front wall 18 to the rear wall 20 to move the debris toward the first lateral wall 22.

A debris catch 40 is mounted in the first lateral wall 22. The debris catch 40 catches debris moved by the brush 34. The debris catch 40 is removable from the housing 12. In particular, the debris catch 40 may include a compartment 42 having an upper wall 44 and a peripheral wall 46 that includes an outer wall 48, a first side wall 50 and a second side wall 52. A container 54 may be removably positioned within the compartment 42 and positioned on a railing 56 attached to the peripheral wall 46.

A vacuum 58 is mounted on the housing 12. A first hose 60 and a second hose 62 are each fluidly coupled to the vacuum 58. The first hose 60 extends through the top wall 14 and is positioned between the front wall 18 and the brush 34. The second hose 62 has a free end 63 that is positioned outside of the housing 12 and is configured to be directable. The vacuum 58 may be operatable in a first direction expelling air outwardly of the first hose 60 and suctioning air into the second hose 62 or in a second direction expelling air outwardly of the second hose 62 and suctioning air into the second hose 62. In this manner, the second hose 62 may be used as a blower if needed to either blow materials away from surface or to pull material off of a surface with the first hose 60 and eject it out of the second hose 62. The vacuum 58 may be powered by a rechargeable battery or power cord plugged into a power source if electric, or may be powered by an internal combustion engine. An actuator 64 is operationally coupled to the vacuum 58 to engage the vacuum 58 in the first direction or the second direction. The actuator 64 is mounted on the handle 26.

In use, the apparatus 10 is rolled across a surface, such as a floor, walkway or the like and the brush 34 moves debris from the surface toward the debris catch 40 and may be used for simply moving debris into a line that allows for easy collection thereof. The vacuum 58 may be used for its vacuuming abilities as well as allowing it be used for blowing functions such as blowing leaves off of a walkway.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A floor cleaning assembly comprising:

a housing having a top wall and a perimeter wall being attached to and extending downwardly from said top wall, said perimeter wall including a front wall, a rear wall, a first lateral wall and a second lateral wall;

a plurality of wheels being rotatably coupled to said housing, each of said first and second lateral walls having two of said wheels positioned thereon;

a brush being mounted to said housing beneath said top wall;

a debris catch being mounted in said first lateral wall, said first lateral wall extending laterally outwardly from said housing to accommodate said debris catch, said debris catch catching debris moved by said brush, said brush being configured to direct debris toward said debris catch; and a handle being attached to and extending upwardly from said housing wherein said brush includes:

an elongated spindle extending between said first and second lateral walls;

a plurality of bristles being mounted to said spindle, said spindle being mechanically coupled to a first wheel of said plurality of wheels such that said spindle rotates when said first wheel rotates, said brush rotating in a first direction configured to move debris toward said front wall, said brush being angled from said front wall to said rear wall to move the debris toward said first lateral wall, said spindle being entirely positioned between said first and second lateral walls.

2. The assembly according to claim 1, wherein said debris catch is removable from said housing.

3. The assembly according to claim 1, further including a vacuum being mounted on said housing, a first hose and a second hose each fluidly coupled to said vacuum, said first hose extending through said top wall and being positioned between said front wall and said brush, said second hose having a free end being positioned outside of said housing and being configured to be directable, said vacuum being operatable in a first direction expelling air outwardly of said first hose and suctioning air into said second hose or in a second direction expelling air outwardly of said second hose and suctioning air into said first hose, an actuator being operationally coupled to said vacuum to engage said vacuum in said first direction or said second direction, said actuator being mounted on said handle, said vacuum being powered by electricity or an internal combustion engine.

4. The assembly according to claim 1, further including a vacuum being mounted on said housing, a first hose and a second hose each fluidly coupled to said vacuum, said first hose extending through said top wall and being positioned between said front wall and said brush, said second hose having a free end being positioned outside of said housing and being configured to be directable, said vacuum expelling air outwardly of said second hose and suctioning air into said second hose.

5. A floor cleaning assembly comprising:

a housing having a top wall and a perimeter wall being attached to and extending downwardly from said top wall, said perimeter wall including a front wall, a rear wall, a first lateral wall and a second lateral wall;

a plurality of wheels being rotatably coupled to said housing, each of said first and second lateral walls having two of said wheels positioned thereon;

a brush being mounted to said housing beneath said top wall, said brush including;

an elongated spindle extending between said first and second lateral walls;

a plurality of bristles being mounted to said spindle, said spindle being mechanically coupled to a first wheel of said plurality of wheels such that said spindle rotates when said first wheel rotates, said brush rotating in a first direction configured to move debris toward said front wall, said brush being angled from said front wall to said rear wall to move the debris toward said first lateral wall said spindle being entirely positioned between said first and second lateral walls;

a debris catch being mounted in said first lateral wall, said debris catch catching debris moved by said brush, said debris catch being removable from said housing, said first lateral wall extending laterally outwardly from said housing to accommodate said debris catch;

a vacuum being mounted on said housing, a first hose and a second hose each fluidly coupled to said vacuum, said first hose extending through said top wall and being positioned between said front wall and said brush, said second hose having a free end being positioned outside of said housing and being configured to be directable, said vacuum being operatable in a first direction expelling air outwardly of said first hose and suctioning air into said second hose or in a second direction expelling air outwardly of said second hose and suctioning air into said first hose;

a handle being attached to and extending upwardly from said housing; and an actuator being operationally coupled to said vacuum to engage said vacuum in said first direction or said second direction, said actuator being mounted on said handle.

* * * * *